US005509346A

United States Patent [19]

Kumpf

[11] Patent Number: 5,509,346

[45] Date of Patent: Apr. 23, 1996

[54] VARIABLE DISPLACEMENT COMPRESSOR WITH SIMPLIFIED TORQUE RESTRAINT

[75] Inventor: William J. Kumpf, Lockport, N.Y.

[73] Assignee: General Motors Corporation, Detroit, Mich.

[21] Appl. No.: 453,227

[22] Filed: May 30, 1995

[51] Int. Cl.[6] ..... F01B 3/00; F01B 13/04

[52] U.S. Cl. ..... 92/12.2; 417/222.1; 74/60

[58] Field of Search ..... 92/12.2, 71, 57; 417/222.1, 222.2, 269; 91/505; 74/60

[56] References Cited

U.S. PATENT DOCUMENTS

| | | | |
|---|---|---|---|
| 4,138,930 | 2/1979 | Searle | 92/57 |
| 4,330,725 | 5/1982 | Hintz | 74/60 |
| 4,487,108 | 12/1984 | McLuen | 92/12.2 |
| 4,491,057 | 1/1985 | Ziegler | 74/60 |
| 4,727,761 | 3/1988 | Scalzo | 417/269 |
| 5,112,197 | 5/1992 | Swain | 417/222.2 |
| 5,152,673 | 10/1992 | Pettitt et al. | 417/222 |

*Primary Examiner*—Thomas E. Denion
*Attorney, Agent, or Firm*—Patrick M. Griffin

[57] ABSTRACT

An improved CV joint type of torque restraint for the socket plate of a variable capacity piston compressor. The inner and outer races of the joint have straight ball tracks arrayed along over lapping conical surfaces, with four balls captured therebetween. The inner race is fixed stationary and solid to the cylinder block, while the outer race is fixed to the socket plate. There is no provision for the inner race to shift axially relative to the compressor housing. When the socket plate changes its basic angle relative to the compressor central axis, the balls simply shift within the ball tracks to compensate.

1 Claim, 2 Drawing Sheets

VARIABLE DISPLACEMENT COMPRESSOR WITH SIMPLIFIED TORQUE RESTRAINT

This invention relates to variable displacement compressors in general, and specifically to a torque restraint assembly for such a compressor.

BACKGROUND OF THE INVENTION

Variable capacity piston type automotive refrigerant compressors typically have one sided pistons driven by a nutating wobble plate, sometimes called a socket plate. Because of the fact that the pistons are one sided, the potential exists for changing the stroke of the pistons, and thus the capacity of the compressor, by changing the angle that the plate makes with the central co axis of the drive shaft and compressor housing. The structure that allows the angle to change is an interconnection between the hub and plate that includes a kidney shaped slot and pin that can slide through the slot. A variable force balance on the pistons is created by a changing differential between the crankcase pressure, which presses on the back of the pistons, and the suction pressure, which acts on the front of the pistons, controlled through an interconnecting valve. As the pressure balance acts on the pistons, the pistons transfer the changing net force to the plate to change its angle relative to the central axis, and the pin slides passively through the slot to a new rest position. The driving connection between hub and plate remains one to one, however, regardless of the movement of the pin through the slot.

Two different basic structural relationships between the nutating plate and the central drive shaft are found in the prior art. In one basic design, the nutating plate that drives the pistons itself rotates about a spherical bearing on the shaft as it nutates, rotating one to one with the hub. An example may be seen in U.S. Pat. No. 4,664,604. In another basic design, the nutating socket plate does not rotate about the shaft axis one to one with the hub and shaft. Instead, the driving connection between the hub and socket plate is made indirectly, through an intermediate journal interposed between the socket plate and hub. The journal turns one to one with the hub and shaft, and imparts the same nutating motion to the socket plate, but rotates freely relative to the stationary socket plate on thrust and radial bearings. The pin and slot assembly that allows angular change interconnects the journal and hub, rather than directly interconnecting the socket plate and hub. The journal, in turn, is allowed to shift axially over the shaft as its angle changes relative to the shaft by virtue of being pivotally mounted to a sleeve that slides axially on the drive shaft. When the journal changes angle, it transmits the same angle change to the socket plate, which remains parallel to the journal. While the journal turns one to one with the shaft driven hub, the socket plate is restrained from rotating by a small spherical bearing installed near its outer edge, which slides back and forth along a guide pin that is parallel to the housing central axis. A typical example of the guide pin type of socket plate anti rotation mechanism is shown in co-assigned U.S. Pat. No. 4,428,718.

A drawback of the basic guide pin torque restraint design is the fact that the socket plate is subjected to a twice per rotation torsional oscillation as it rotates, due to the angular mismatch between the socket plate and shaft-hub axes. This in turn causes compressor vibration. Another co-assigned U.S. Pat. No. 5,129,752 recognized the problem, and proposed a novel replacement for the guide pin type of socket plate torque restraint assembly. It was replaced with a ball and track type of constant velocity joint, known as an Rzeppa joint, which is normally used for the very different purpose of transmitting torque from a rotating driving shaft to a driven shaft. Here, however, by fixing the outer joint race coaxially to the socket plate, and by securing the inner joint race so as to remain coaxial to the hub, but non rotatable relative to the compressor housing, the socket plate is restrained against rotation in a way that balances out the torsional oscillation. Critical to the design is the structure that allows the inner joint race to remain coaxial to the hub without rotating. This is a totally separate shaft, called an anti rotational shaft 52, which is coaxial to the drive shaft. The anti rotational shaft 52 also must be axially slidable on splines within the compressor housing, and spring loaded toward a return position. This allows the shaft and the inner joint race to axially shift when the angle of the socket plate changes, providing the same function that the sliding sleeve in a conventional socket plate design does. This extra shaft, as well as the Rzeppa joint, adds a good deal of structural complexity, however, compared to a simple guide pin and spherical bearing.

SUMMARY OF THE INVENTION

The invention provides a compressor in which a different constant velocity joint provides the same basic function as the design just described, but with a much simpler structure.

In the embodiment disclosed, the constant velocity joint used for torque restraint is of a type that self adjusts to compensate for the axial shifting or stroking that is usually incident to changing the angle of the socket plate. Therefore, the inner race can simply be directly fixed to the compressor housing, coaxial to the compressor central axis, but completely stationary. The outer race, as in the design described above, is retained securely within the socket plate, coaxial thereto, and is supported relative to the journal by thrust and radial bearings that allow the journal to rotate freely relative both to the outer race and socket plate. The inner and outer races have simple, straight ball tracks arrayed along conical surfaces, which overlap and contain a plurality of balls captured therebetween. At any given angle of the socket plate, the balls roll back and forth in the ball tracks over a defined path. When the socket plate angle changes, the balls shift within the tracks, and thereafter roll back and forth about a different path. The inner race itself need not shift axially, however. Therefore, no additional inner race mounting structure is necessary to secure the inner race to the compressor housing.

DESCRIPTION OF THE PREFERRED EMBODIMENT

These and other objects and features of the invention will appear from the following written description, and from the drawings, in which.

Figure 1:
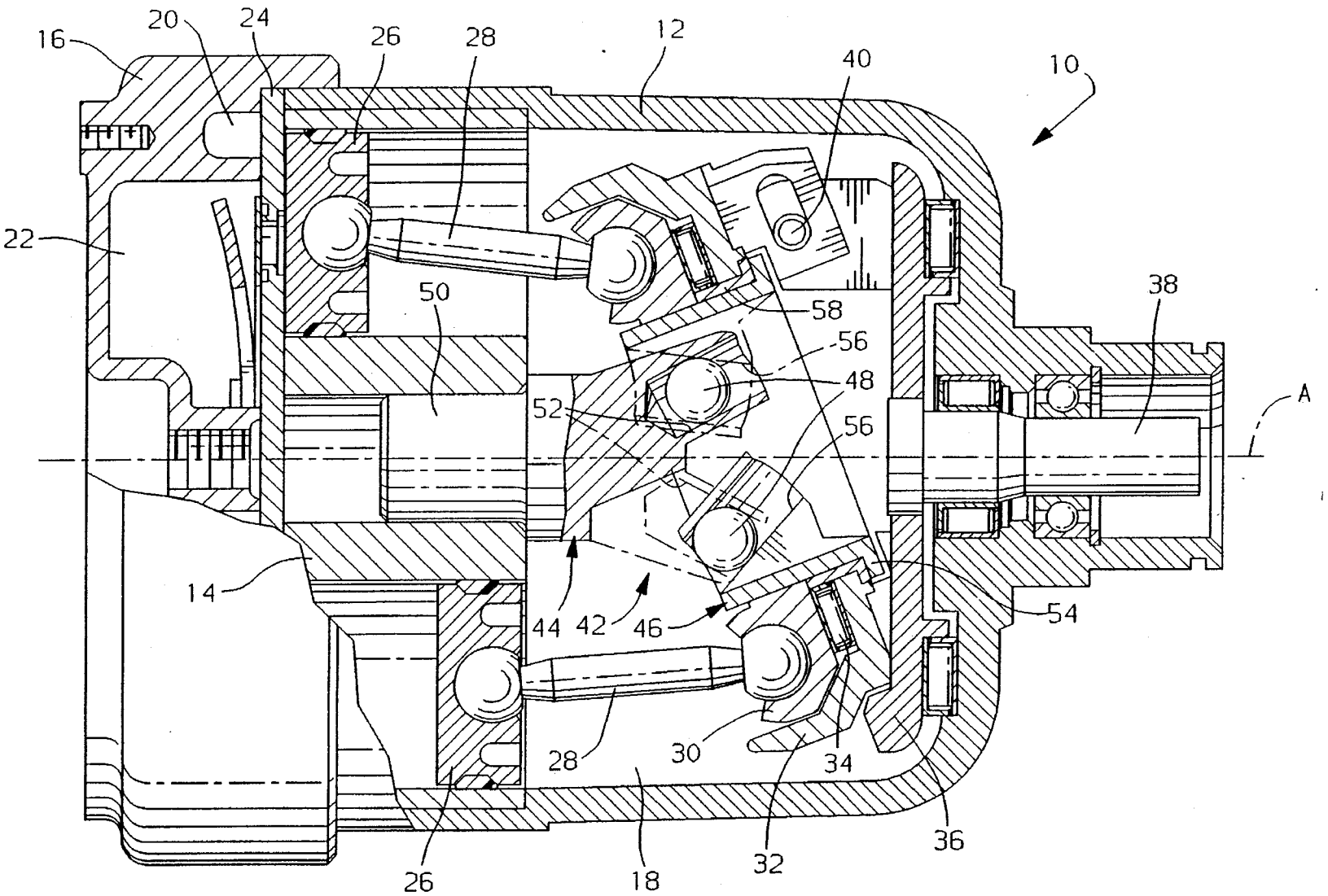
FIG. 1 is a cross section through the housing of a compressor incorporating the torque restraint assembly of the invention.

Referring first to FIG. 1, a variable capacity compressor, indicated generally at 10, has a basically cylindrical housing 12, with a central axis indicated at A. Housing 12 surrounds a cylinder block 14 and is closed with a head 16. Behind block 14 is a crankcase cavity 18, and within head 16 are a suction chamber 20 and discharge chamber 22, which are filled and exhausted by a conventional valve plate 24. A conventional control valve, not shown, establishes a pressure force balance between the various cavities and chambers 18, 20 and 22 which acts on the front and back sides of a plurality of conventional pistons 26 to vary their stroke, in cooperation with the mechanism that drives the pistons 26.

Still referring to FIG. 1, and moving from left to right, each piston 26 is reciprocated by an individual double spherical ended piston rod 28, one end of which is pivoted to the back of a respective piston 26 and the other end of which is pivoted to the edge of a wobble plate or socket plate 30. Socket plate 30 is driven, but not rotated about axis A, by a journal 32, which is held flat and parallel to the back of socket plate 30 against a thrust bearing 34. Specifically, socket plate 30 is nutated by journal 32, meaning that its edge shifts axially back and forth, thereby reciprocating the pistons 26 back and forth. Journal 32 nutates because it normally resides at an angle relative to axis A, and it is rotated about axis A, by a bearing supported rotary drive hub 36. Hub 36 is located on the right side socket plate 30, and is rotated on axis A by a short, beating supported central drive shaft 38, which is ultimately powered by a vehicle engine through a non illustrated pulley and clutch assembly. Journal 32 is able to reside at an angle relative to axis A because the hub 36 and journal 32 are indirectly drivingly connected through a pin a slot assembly 40, and because socket plate 30 is able to pivot about axis A on a structure described in detail below. Pin and slot assembly 40 allows hub 36 to spin journal 32 with no lost motion regardless of the shifting of the pin and slot assembly 40 that allows that angle to change. All the piston drive components described thus far are basically conventional. A means is also needed to prevent socket plate 30 from rotating about axis A, however, since the piston rods 28 cannot provide that function. That torque restraint assembly, indicated generally at 42, is new, and described next.

Figure 2:
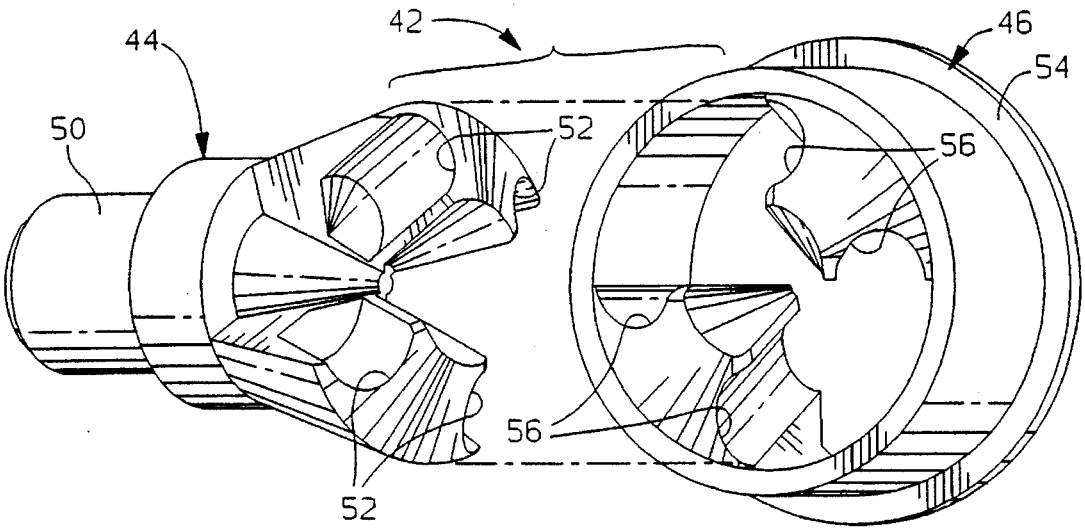
FIG. 2 is a disassembled perspective view of the inner and outer ball joint races.
Figure 3:
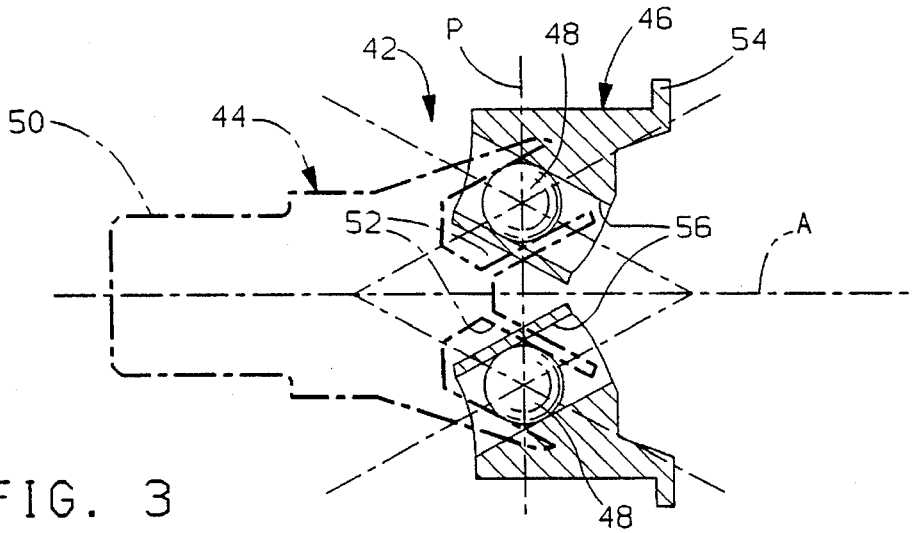
FIG. 3 is a partially schematic view of the ball races showing the configuration of the ball tracks and showing the races co axial, when the socket plate and pistons are at minimum stroke.
Figure 4:
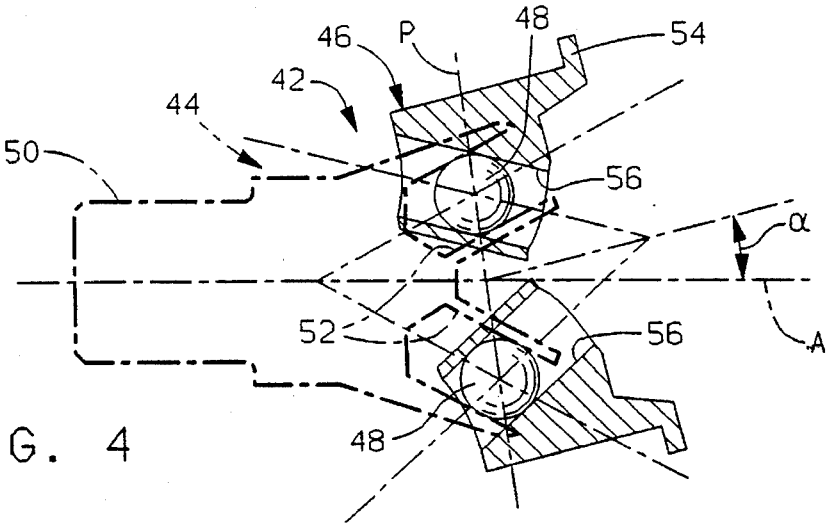
FIG. 4 is a view like FIG. 3, but showing the races at a relative angle, when the socket plate would drive the pistons with a significant stroke.

Referring next to FIGS. 3 and 4, torque restraint assembly 42 includes an inner ball joint race, indicated generally at 44, an outer ball joint race, indicated generally at 46, and four balls 48. Inner ball joint race 44 is basically forked and conical in shape, but for a cylindrical base 50. Four straight ball tracks 52, which are semi cylindrical in cross section, are arranged in two oppositely facing pairs, and arrayed along a conical surface that diverges from left to right, indicated by a V shaped dotted line in FIG. 3. Outer ball joint race 46 is basically cylindrical on its outer surface, but for an annular flange 54 at one end, and hollow, so that inner race 44 can be at least partially inserted therethrough. The interior of outer ball joint race 46 is machined with four straight ball tracks 56, also semi cylindrical in cross section, and also arranged in two oppositely facing pairs arrayed along a conical surface, but converging from left to right, and also indicated by a V shaped dotted line. When inner race 44 is inserted coaxially within outer race 46, as shown in FIG. 2 the two pairs each of oppositely sloped ball tracks 52 and 56 overlap, so that the four balls 48 may be captured therebetween. The nature of a ball joint like 42, which is commonly called a Weiss joint, is such that the balls 48 will always seek a plane P that bisects the angle between the axes of the races 44 and 46. When the races are coaxial, as in FIG. 3, then the plane P is simply perpendicular to the co axis. The co axial position of the races 44 and 46 is not one that would normally occur in operation, but serves to illustrate well their structural inter relationship.

Referring again to FIG. 1, the torque restraint assembly 42 of the invention is incorporated into compressor 10 in a structurally simple manner. Inner race 44 is press fit centrally into cylinder block 14, coaxial to central axis A, and is completely stationary, both axially and rotationally. It is located on the opposite side of socket plate 30 from hub 36, and there is no direct structural connection or interference therebetween. Outer race 46 is press fit tightly within socket plate 30, so that its annular flange 54 captures a flanged plane bearing 58, thereby maintaining journal 32 snug against axial thrust bearing 34. The same plane bearing 58 serves to radially support journal 32 for rotation over the cylindrical outer surface of outer race 46. As such, outer race 46 remains coaxial and stationary relative to socket plate 30, taking on whatever angle it attains. Outer race 46 does not interfere with the rotation of journal 32, however, and even serves to support journal 32 structurally relative to socket plate 30. The total part count is substantially reduced from the prior designs described above, therefore. The primary purpose of outer race 46 is to provide torque restraint for socket plate 30, as well as providing the pivot that allows it to change angle, as is described next.

Referring next to FIGS. 1, 2 and 3, the operation of assembly 42 is illustrated. Assuming that socket plate 30 is at an angle relative to axis A when the piston 26 shown is in the fully forward position illustrated, then, as shaft 38 spins and rotates hub 36, journal 32 and socket plate 30 are nutated, which reciprocates the piston rods 28 and pistons back and forth over a stroke corresponding to the size of the angle. The races 44 and 46 concurrently pivot relative to one another, for example, from the angle alpha shown in FIG. 4 above axis A, down past the axis A and down to the same angle below axis A, then back up again as the piston 26 shown returns, once for each revolution. As the races 44 and 46 pivot relative to one another, they are prevented from rotating, so the socket plate 30 is prevented from rotating, as well. The balls 48 roll back and forth within and between the ball track 52 and 56, but remain always on the bisecting plane P described above. The plane P, of course, shifts dynamically as the angle changes over a single rotation, so the balls 48 roll back and forth over a limited path, symmetrically relative to a defined mid point. This characteristic removes the torsional oscillation to which a conventional, guide pin restrained socket plate is subject, just as in the prior CV joint design described above. In addition, the restraining torque provided to the socket plate 30 by the assembly 42 is transferred, ultimately, to the solid cylinder block 14 through the inner race 44. This grounding of the restraining torque is far more robust and solid than it is in the prior CV joint restrained compressor described above. There, the securement to the cylinder block is through a relatively small diameter key 54 that must be allowed to slide axially through the block, which inevitably would involve some clearance and rattle. Here, the inner race 44 is solidly and securely fixed into the block 14 through the large diameter, stationary base 50.

Referring next to FIGS. 4, the more solid securement of the inner race 44 is, in turn, made possible because of the fact that the type of basic CV joint which comprises the assembly 42 allows the angle between the races 44 and 46 to change without the necessity for the inner race 44 to axially shift relative to the housing 12. The changing of the angle referred to here does not mean the dynamic shifting that always occurs with each revolution, but rather change to the angle that the socket plate 30 characteristically assumes each time the piston 26 is fully forward, at so called top dead center. This "static" change occurs only when the force balance on the pistons 26 changes, which is an indication of a need for capacity change. Assuming that this angle of the socket plate 30 shifts, for example, from the FIG. 4 angle alpha to an angle that is half that, then the piston total stroke decreases. The axial shifting provided in the old designs described above is internally provided now by the balls 48. Specifically, the path that the balls 48 follow, as defined above, would take on a different mid point within the ball tracks 52 and 56. Therefore, when the socket plate 30 and journal 32 are forced to a different angle (as allowed by the pin and slot assembly 40), no axial shifting of the inner race 44 need be provided for, as with the old designs. The outer race 46 can shift to a different angle relative to the stationary inner race 44 simply by the shifting of the balls 48 to a different overall path. The result is both a much simpler and more robust restraint assembly 42.

I claim:

1. An assembly for providing torque restraint to a socket plate of a variable displacement piston compressor of the type in which said socket plate is nutated by a journal that is supported coaxially on and is axially fixed to said socket plate, but rotates freely around said socket plate, and which journal is driven by a rotating hub located on one side of said socket plate which is rotatably supported coaxial to the central axis of a compressor housing, and in which the journal and hub are interconnected so as to allow the angle of said socket plate relative to said hub to adjust, said torque restraint assembly comprising, an inner ball joint race non rotatably and axially fixed relative to said housing on an opposite side of said socket plate and coaxial to said central axis, said inner ball joint race having a plurality of straight inner ball tracks arrayed along a conical surface the slope of which diverges relative to said hub, an outer ball joint race supported coaxially within and axially fixed relative to said socket plate such that said journal may rotate freely about said outer ball joint race and socket plate concurrently, said outer ball joint race having an equal plurality of oppositely sloped, straight outer ball tracks arrayed along a conical surface, so that said outer and inner ball tracks overlap one another in a plane that bisects the angle between said socket plate and hub axes, and, a plurality of balls captured in the area of overlap between said overlapping inner and outer ball tracks and arrayed in said bisecting plane, whereby, as said socket plate is nutated by said journal and hub, said socket plate is restrained against rotation relative to said compressor housing as said balls roll back and forth in said ball tracks, and as said angle between said socket plate and hub axes changes, said balls shift within said ball tracks and remain in a plane that bisects the angle between said socket plate and hub axes.

* * * * *